US006474049B1

(12) United States Patent
Lipes et al.

(10) Patent No.: US 6,474,049 B1
(45) **Date of Patent: *Nov. 5, 2002**

(54) AUTOMATIC TURRET BAGGING MACHINE

(75) Inventors: Arnold Lipes, Montreal; Bruno Wetter, Cote St. Luc, both of (CA)

(73) Assignee: Glopak Inc., Montreal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/488,695

(22) Filed: Jan. 20, 2000

(51) Int. Cl.[7] ..... B65B 57/10
(52) U.S. Cl. ..... 53/494; 53/501
(58) Field of Search ..... 53/501, 57, 494, 53/503, 534, 237, 246, 247, 250

(56) References Cited

U.S. PATENT DOCUMENTS 2,934,869 A * 5/1960 Engleson et al. ..... 53/494
3,670,474 A * 6/1972 Vieson et al. ..... 53/55
4,283,901 A * 8/1981 Schieser et al. ..... 53/75
4,864,801 A * 9/1989 Fallas ..... 53/446
5,199,245 A * 4/1993 Daddario et al. ..... 53/447
5,570,562 A * 11/1996 Anderson ..... 53/250
5,813,196 A * 9/1998 Pagé et al. ..... 53/448
5,881,532 A * 3/1999 Kitagawa ..... 53/54
5,890,350 A * 4/1999 Tisma ..... 53/543
6,119,441 A * 9/2000 Lipes et al. ..... 53/570

* cited by examiner

*Primary Examiner*—John Paradiso
(74) *Attorney, Agent, or Firm*—Carter & Schnedler, P.A.

(57) ABSTRACT

An automatic turret bagging machine utilizes a turret transport mechanism having four article receiving compartments to receive liquid pouches, herein milk pouches, oriented longitudinally therein. An indexing motor drives the turret transport mechanism between an article loading position, an article discharge position, an intermediate position and an article unloading position. A control plate is synchronized with the turret transport mechanism and provides a support for a follower bearing member secured to the trap door of each of the compartments whereby to retain and release articles loaded in the compartments. The control plate also has a formation which automatically recloses the trap doors of the compartment upon reaching a predetermined position and simultaneously repositions the follower bearing member with a lower surface of the control plate. In the event that an improper number of pouches are loaded in a compartment, that compartment will not unload and the discharge position and the bag opening and positioning mechanism will idle during one cycle step and the improper number of pouches will automatically be discharged at the article unloading position for recycling.

18 Claims, 7 Drawing Sheets

AUTOMATIC TURRET BAGGING MACHINE

CROSS-REFERENCE TO RELATED APPLICATION

This application is related with Application Ser. No. 09/294,186, filed on Apr. 19, 1999 and entitled "AN AUTOMATIC BAGGING MACHINE", assigned to the assignee of the present application.

TECHNICAL FIELD

The present invention relates to an automatic turret bagging machine wherein the trap walls of the compartments are controlled by a control plate and wherein an insufficient number of pouches loaded in the compartments of the turret transport mechanism will be detected and unloaded for recycling.

BACKGROUND ART

Various types of automatic bagging machines are known for placing all sorts of articles into an open top end of a bag held under an article transport and discharge mechanism. It is also known to transport articles in compartments of a turret and to load them at a loading station and to discharge them at a discharge station.

The present invention is concerned with these types of automatic bagging machines utilizing turret transport mechanisms. However, a problem which exists with these transport mechanism is that often an improper number of articles are placed into the compartments of the turret transport mechanism and these improper number of articles are then discharged into a bag. This causes other problems when handling the bag down line. It is therefore necessary to inspect the bags which are conveyed from the bagging machine to detect improperly filled bags. This is costly and time-consuming and still bags with an improper number of articles therein go undetected and are sold in that state causing further problems at the retail and consumer level. Another problem with these machines is that they are slow in operation and often the bagging machine must be stopped to correct malfunctions and/or improper loading of compartments.

SUMMARY OF INVENTION

It is therefore a feature of the present invention to provide an automatic turret bagging machine which substantially overcomes the above-mentioned disadvantages of the prior art.

Another feature of the present invention is to provide an automatic turret bagging machine which is indexed in synchronism with a displaceable control plate whereby to cause a trap door at the base of the turret compartments to open to discharge the articles placed therein and to automatically close.

Another feature of the present invention is to provide a detection system in combination with the automatic turret bagging machine and wherein the detection system will signal a control circuit to, in turn, control the operation of the control plate in order to discharge an improper number of articles placed into a compartment at a discharge position where these articles can be accumulated and recycled without spoilage.

Another feature of the present invention is to provide an automatic turret bagging machine which can operate at high speed and which can load three milk pouches oriented in side-by-side longitudinal relationship within a carrying bag.

According to the above features, from a broad aspect, the present invention provides an automatic turret bagging machine which comprises a turret transport mechanism having four article receiving compartments. Drive means is provided to displace the compartments in synchronism from an article loading position, an article discharge position, an intermediate position and an article unloading position. Each of the compartments has a circumferential side wall, an open top end and a bottom trap wall. The compartments are dimensioned to receive two or more liquid pouches oriented in a predetermined manner by loading means at the loading position. A bag opening and holding mechanism is provided for positioning and holding an open top end of a bag under the bottom trap wall of the compartments at the article discharge position. Controllable release means is provided to release the bottom trap wall of the compartments upon reaching the article discharge position to release the pouches contained in the compartment into the open top end of a bag positioned thereunder. Transport means is provided to displace the bag with the pouches therein away from the bag opening and holding mechanism. Control means is provided to synchronize the operation of the drive means, the bag opening and holding mechanism, the loading means and the controllable release means.

BRIEF DESCRIPTION OF DRAWINGS

A preferred embodiment of the present invention will now be described with reference to the accompanying drawings in which:

FIG. 2 is a top view of FIG. 1;

DESCRIPTION OF PREFERRED EMBODIMENTS

Figure 1:
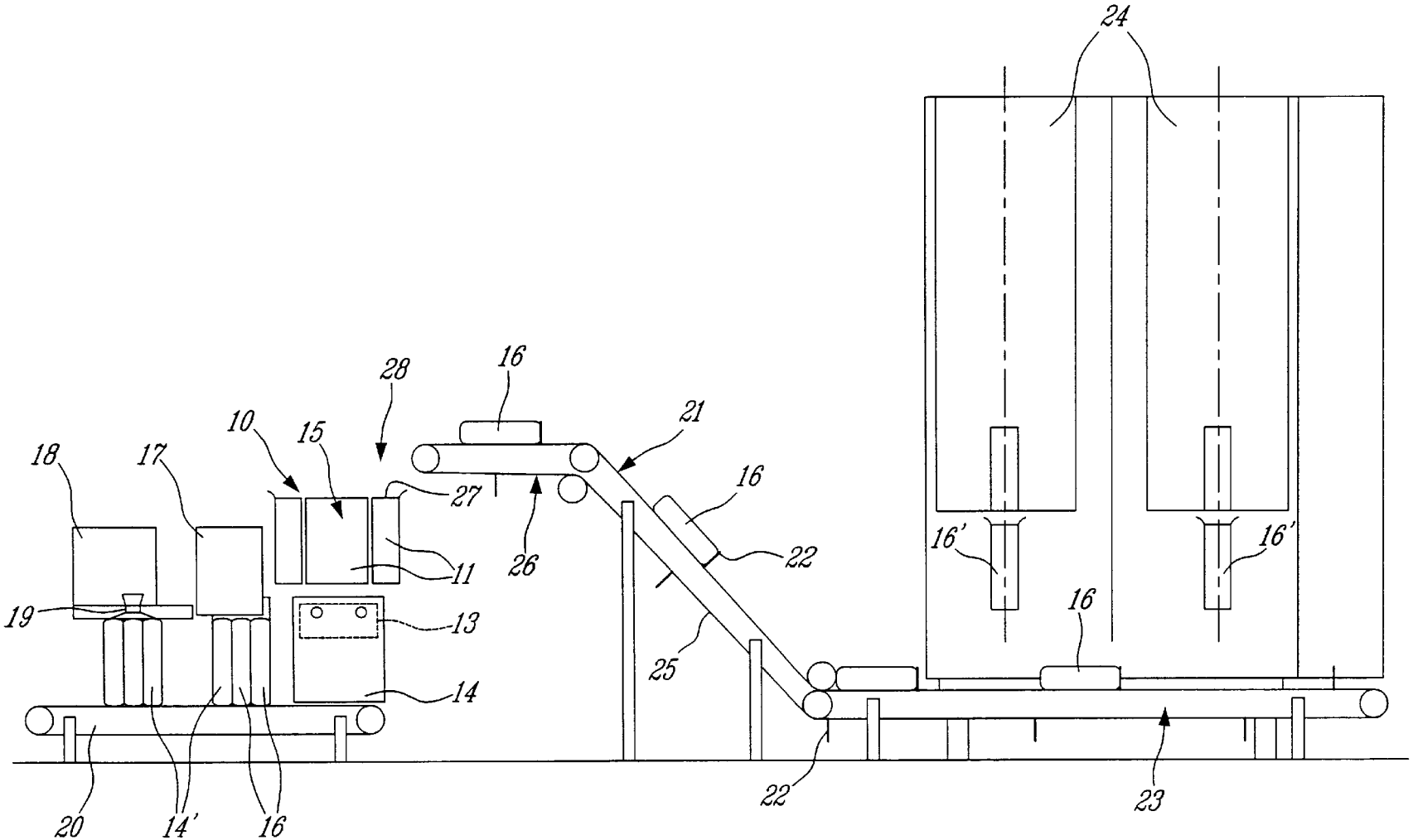
FIG. 1 is a side view of the automatic turret bagging machine of the present invention as utilized with a pouch loading conveyor, a bag opening and holding mechanism and a bag closing assembly of the prior art.
Figure 3:
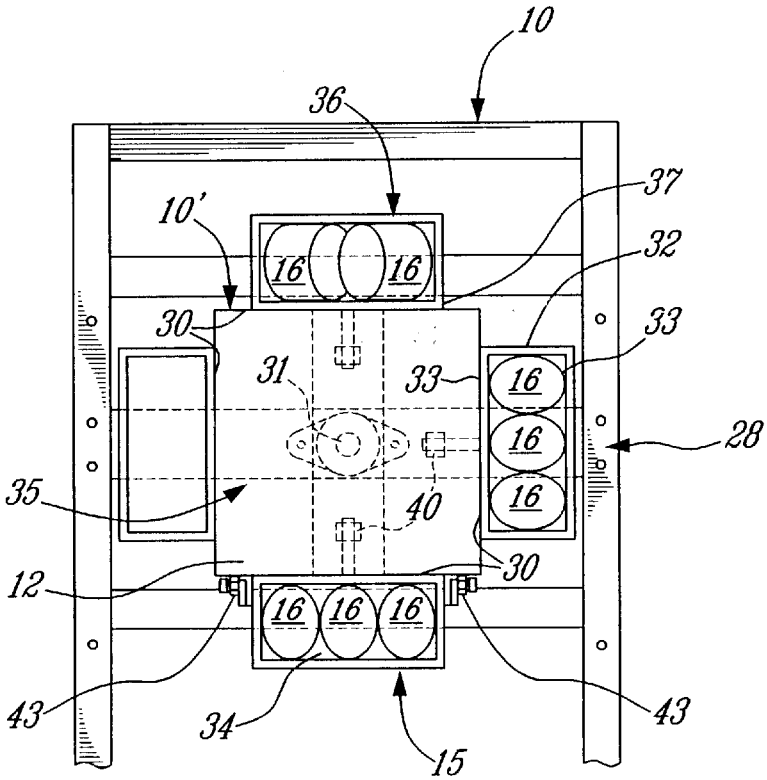
FIG. 3 is a schematic top view of the turret transport mechanism and its compartments.

Referring now to the drawings and more particularly to FIGS. 1 to 3, there is shown at 10 the automatic turret bagging machine of the present invention. The turret bagging machine is a turret transport mechanism 10' provided with four article receiving compartments 11 disposed in spaced parallel relationship to each side of a square support frame 12 as shown in FIG. 3. The turret transport mechanism 10' is supported above and adjacent to a bag opening and holding mechanism 13 as is well known in the art and for example as described in U.S. Pat. No. 5,177,939, dated Jan. 12, 1993. The bagging mechanism 13 engages an outer plastic bag 14' from a plurality of wicketted bags (see FIGS. 6 and 7) and opens the mouth 14" thereof at the article discharge station 15 above the compartments 11.

At the article discharge position 15, articles, herein milk pouches 16 transported in the compartment 11, are released into the open end of the plastic bag 14' (see FIG. 6) held thereunder. The filled bag 14' with a predetermined number of pouches, herein three pouches positioned therein, is conveyed on a transport conveyor to a bag open end film gathering station 17 (well known in the art) wherein gathering brushes will gather the open end of the bag 14' to feed the gathered end into a closure application station 18 where a closure element is positioned about the gathered throat portion 19 of the bag 14'. The bag with the pouches therein is transported on a transport conveyor 20 which displaces the bag with the pouches through the stations 17 and 18 and then discharges the bag onto another conveyor, not shown.

As shown in FIGS. 1 and 2, a feed belt conveyor 21 is provided with spaced-apart pusher plates 22 and fed groups of three milk pouches 16 at a loading end 23 of the conveyor being fed by twin tube fillers 24 also well known in the art. These fillers 24 form the pouches, as illustrated at 16', fill them and seal them and then release the pouches on the loading end 23 of the conveyor at predetermined positions to grasp the pouches. The pouches then travel onto a steep inclined transfer conveyor section 25 to cause the groups 16", see FIG. 2, of three pouches 16 to position themselves by gravity against the pusher plates 22 in side-by-side relationship with the pouches oriented longitudinally. The pouches then move on to a discharge end 26 of a conveyor 25 where they are released into the open top end 27 of the compartment 11 at the loading station 28. The conveyor 21 is synchronized with the turret transport mechanism 10'.

Figure 4:
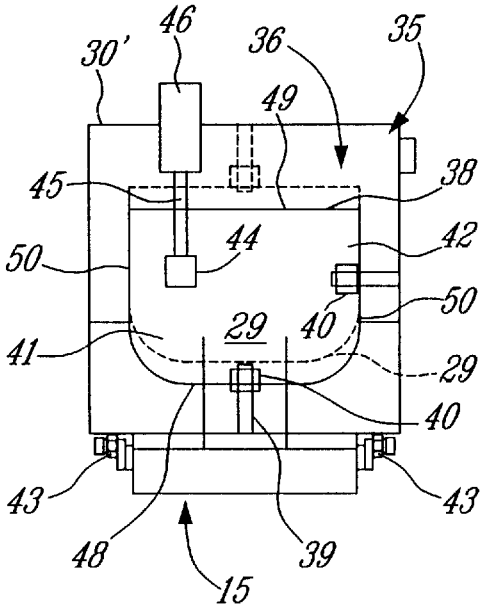
FIG. 4 is a bottom view illustrating the position of the control plate and its association with the turret transport mechanism and the follower bearing member connected to the bottom trap wall of each of the compartments of the turret transport mechanism.
Figure 5:
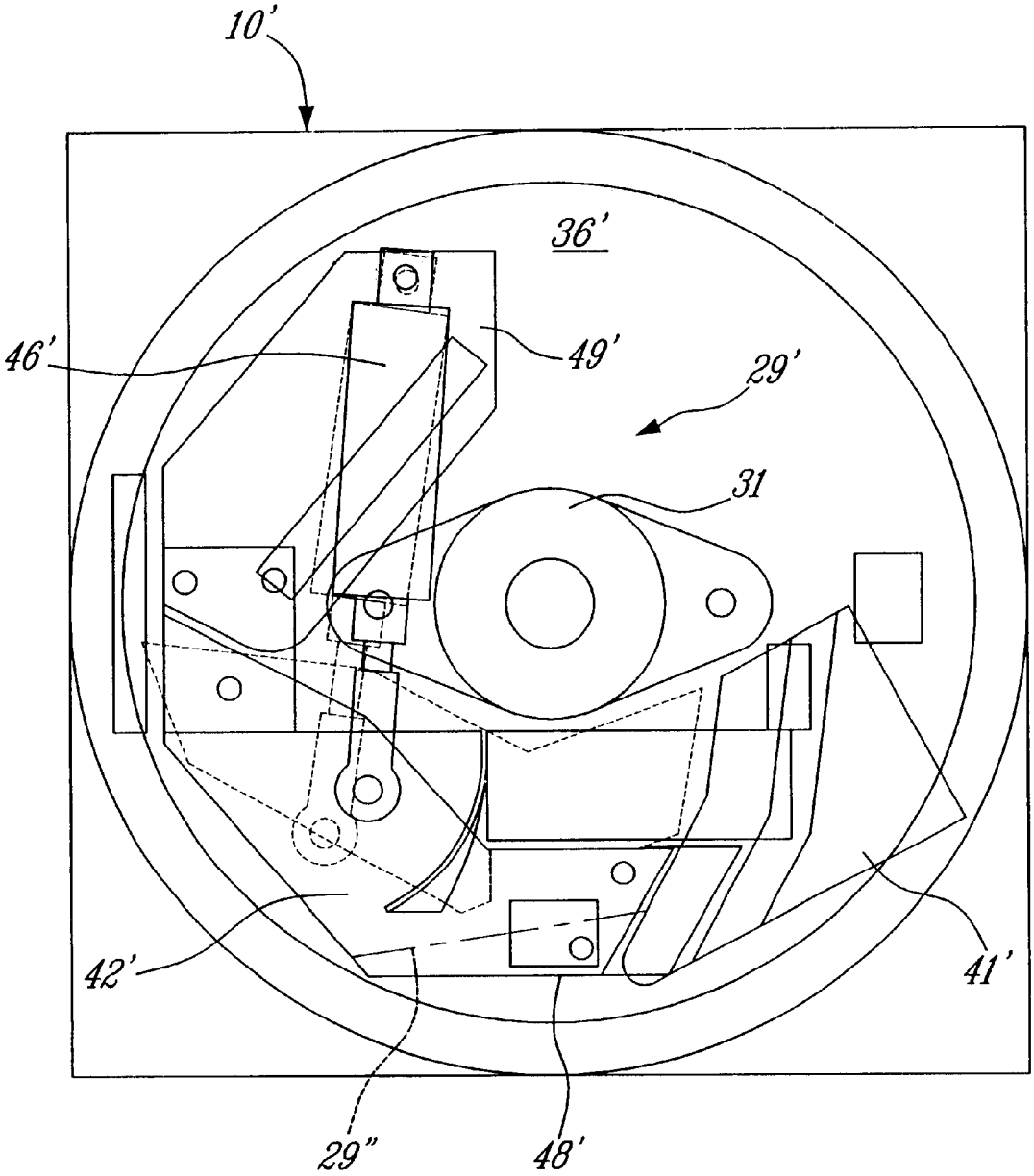
FIG. 5 is a bottom plan view showing the actual construction of the control plate for repositioning the bottom trap wall of the compartments to a closed position.

Referring now to FIGS. 3 to 5, there will be described the operation of the turret transport mechanism 10' of the present invention and its control plate 29 disposed thereunder. As shown in FIG. 3, the square support frame 12 of the turret transport mechanism 10' has a compartment 11 secured to each of the opposed parallel side frame 30 thereof and the support frame 12 is rotated by an indexing motor 31 which displaces the compartments 11 in a clockwise direction and at positions of 90° with respect to one another. Each compartment has a circumferential side wall and as herein shown of a rectangular cross-section defining opposed end walls 32, opposed side walls 33, a bottom trap wall 34 and an open rectangular top end 27, as previously described. The milk pouches 16 are loaded into the compartment at the loading position 28 with the milk pouches being received in close fit within the compartments 11, as illustrated in FIG. 3.

Figure 7:
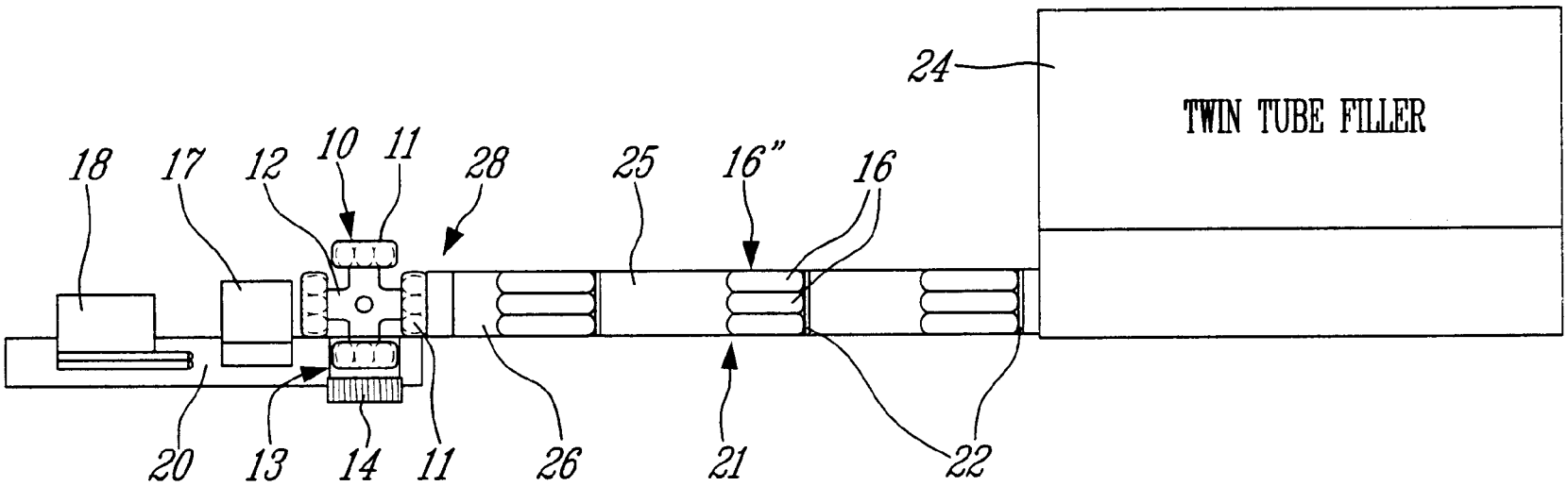
FIG. 7 is a view similar to FIG. 6 but illustrating the discharge of the pouches within the transport compartment at the discharge position and into an open end of a bag held under the trap wall of the compartment.
Figure 6:
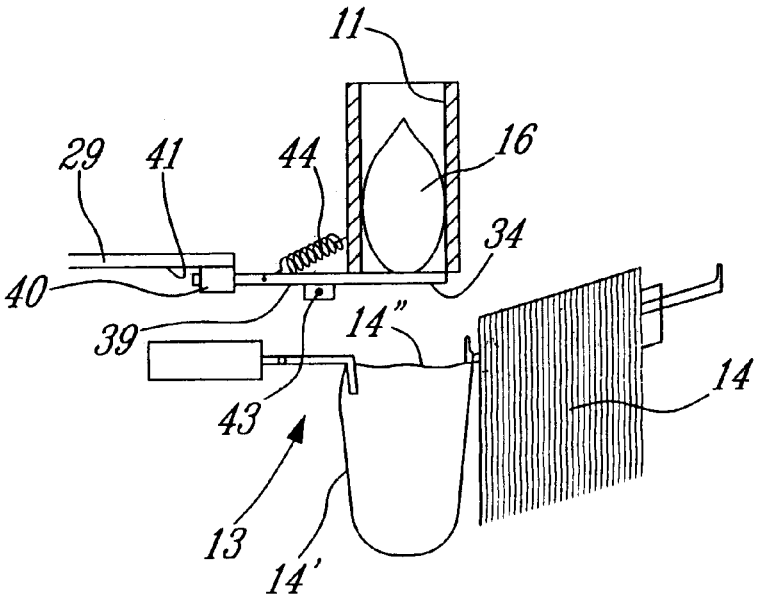
FIG. 6 is a simplified sectional side view showing a transport compartment of the turret transport mechanism approaching the unloading position with a bag being opened thereat and under the bottom trap wall of the compartment.
Figure 7:
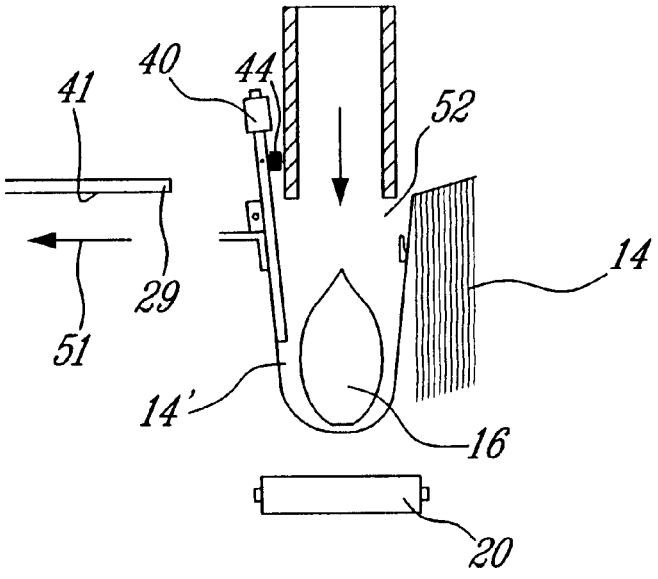

The motor 31 is then operated to move the compartment from the loading position 28 to the discharge position 15 where the bottom trap wall 34 is released to discharge the articles within the open top end of the bag 14' supported thereunder (see FIGS. 6 and 7). The bag 14' is then released and conveyed free of the trap wall 34. The trap wall 34 remains open as the support frame 12 moves the compartment to an intermediate position 35 unless the compartment carries an improper number of pouches which have been detected and which have not been released at the discharge position 15, as will be described later. During the next indexing cycle of the motor 31, the compartment is moved to a bag discharge position 36. If there are an improper number of pouches within the compartment, they are discharged at this position by the control plate 29, as will be described later. If the trap wall 34 is open, then it remains in that open position.

As shown in FIGS. 4 and 5, as the indexing motor 31 rotates the support frame 12 from the discharge position 36 to the loading position 28, the leading edge 37 of the bottom trap wall 34, which is depending, will abut against an edge formation 38 of the control plate 29 to cause the trap wall 34 to hinge upwardly under the open bottom end of the compartment and with its bearing element engaged under the control plate whereby to close the compartment.

The control plate 29 constitutes a controllable release means and the plate is displaceably supported in a plane disposed relative to the bottom trap wall of the compartments. The bottom trap walls of the compartments are also provided with biased follower means secured thereto and herein constituted by a rod 39 having a follower bearing or roller element 40 secured adjacent a free end thereof. The roller element 40 is disposed under the bottom surface of the control plate 29, as shown in FIG. 4, and rides along a peripheral edge portion 42 of this surface. This is better illustrated in FIG. 6 and as can be seen, the bottom trap wall 34 and the connecting rod 39 secured thereto are displaceable on a pivot connection 43. A spring 44 may be connected to the connecting rod 39 to urge it upwardly to a trap wall release position, as shown in FIG. 7.

Figure 10:
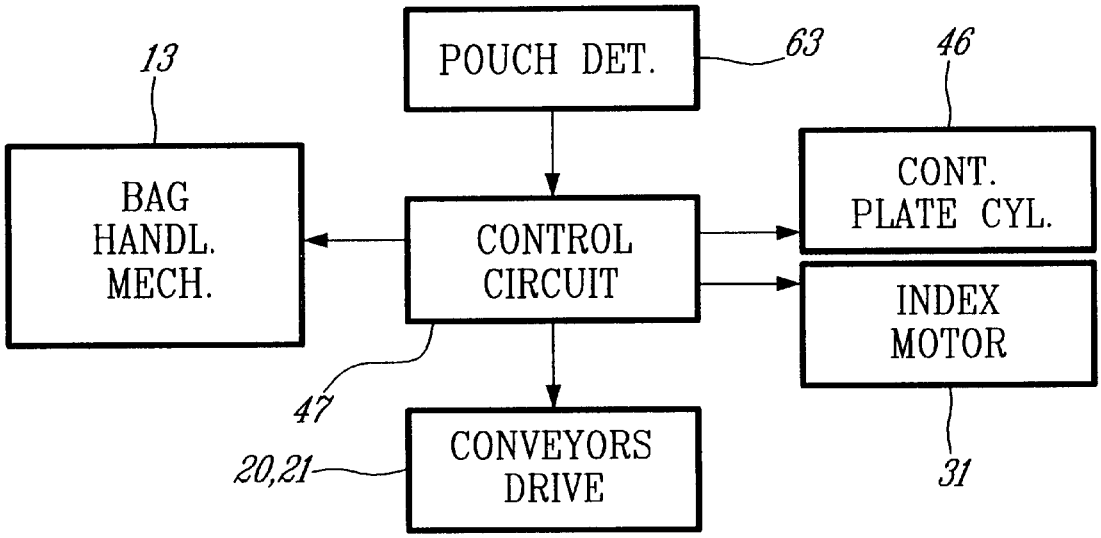
FIG. 10 is a simplified block diagram of the control circuit system.

The control plate 29 is displaceable in its plane by a piston rod connection 46' secured to a piston rod 45 of a piston cylinder 46. This piston cylinder is controlled by a control circuit 47, as shown in FIG. 10. The indexing motor 31 is also controlled by the control circuit 47. The control circuit 47 also controls all of the conveyor drives of the system.

As shown in FIGS. 4 and 5, the control plate 29, or plate assembly 29' is configured so that the roller element 40 travels substantially along the peripheral flat portion 42, 42' of its lower arresting bottom surface 41, 41'. The control plate has a front edge 48, 48' which is disposed spaced behind the article discharge position 15 and a rear edge 49, 49' disposed spaced a greater distance from the article unloading position 36, 36'. It also has opposed parallel side edges 50 disposed respectively adjacent the article loading position 28 and the intermediate position 35. Upon receiving of a signal from the control circuit 47, the piston cylinder 46, 46' is actuated to draw the plate to its position as shown in phantom lines at 29' in FIG. 4, whereby to release the roller element 40 from its engagement with the bottom surface 41 of the control plate 29 as illustrated in FIG. 7. The control plate is withdrawn in the direction of arrow 51, as illustrated in FIG. 7.

As can be seen from FIGS. 6 and 7, the weight of the pouches 16 within the compartment 11 will cause the bottom trap wall 34 to pivot wherein the pouches 16 are released by gravity into the open top end 52 of the bag 14' retained open under the compartment at the article discharge position 15. The spring 44 ensures that the trap wall 34 is open at all times when the roller element 40 is released from the surface 41 by the displacement of the control plate. When the control plate is in its retracted position, as shown in phantom line in FIG. 4, it can be seen that the rear edge 49 of the control plate is closer to the rear side frame 30' of the support frame 12 whereby to position the abutment edge formation 38 along the path of displacement of the compartments to cause the leading edge 37 of the trap wall of the compartment at the discharge location 36 to move up onto the edge formation 38 prior to reaching the loading position 28 and thereby positioning the follower roller element 40 back under the control plate and in contact with the bottom surface 41 thereof. Once the compartment reaches the loading position, it is arrested momentarily and during this short period of time the control circuit 47 actuates the control plate cylinder 46 to reposition the control plate to its position as shown in solid line in FIG. 4.

Figure 8:
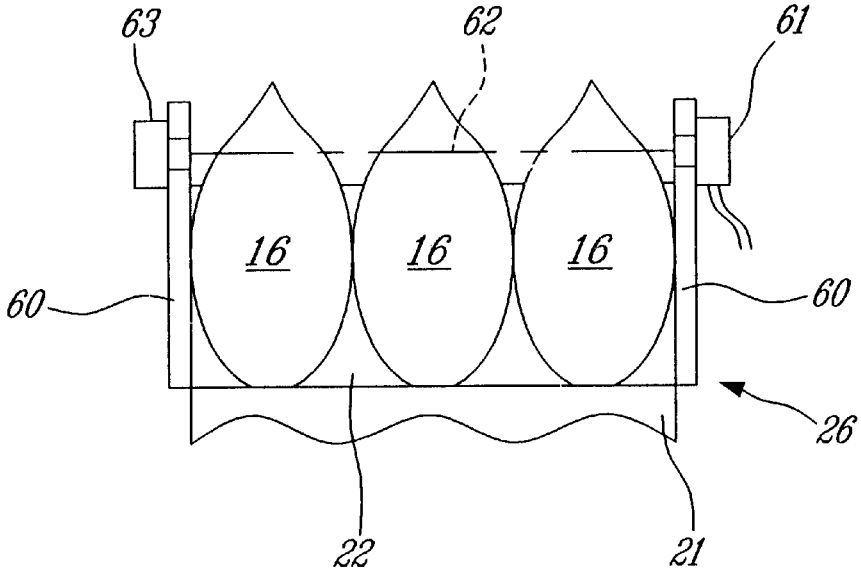
FIG. 8 is a simplified fragmented sectional view illustrating the construction of the pouch detection system for detecting proper and improper number of pouches being released into the compartment of the turret transport mechanism at the loading position.
Figure 9:
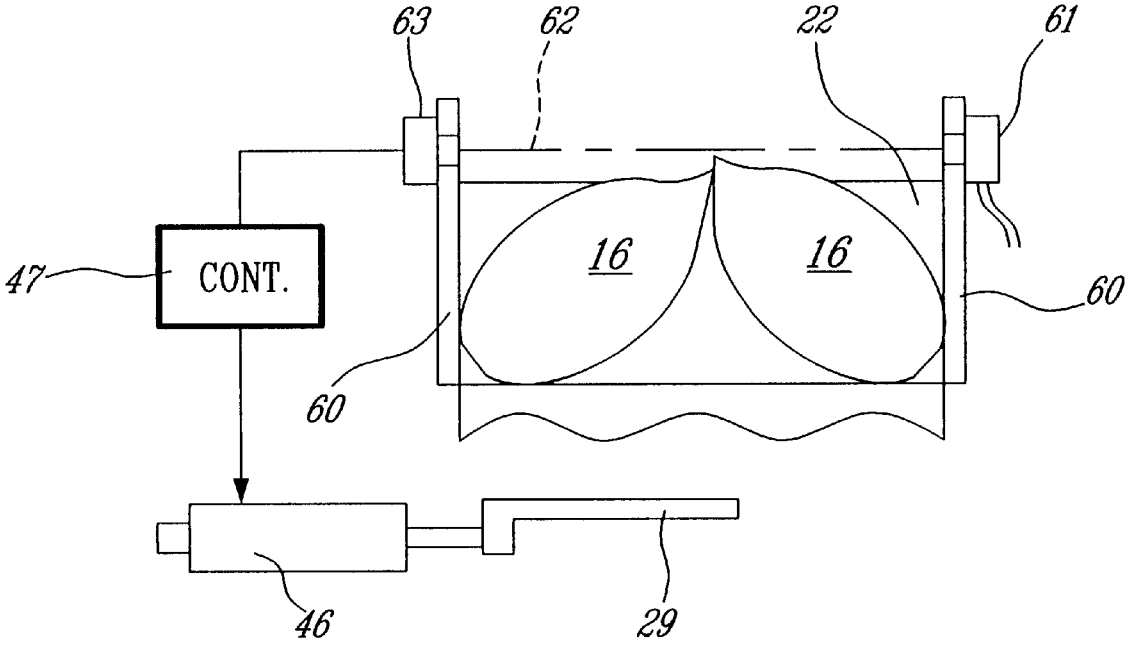
FIG. 9 is a view similar to FIG. 8 but illustrating an improper quantity of pouches being discharged at the loading position.

With additional reference now to FIGS. 8 and 9 there will be described a detection system whereby to detect that there is a proper number of milk pouches 16 at the discharge end 26 of the feed belt conveyor 21. As shown in FIG. 8, the feed belt conveyor 21 is provided with side guide plates 60, which guide the three milk pouches 16 in close side-by-side longitudinally aligned relationship and holds them captive between the side plates. An infrared beam transmitter 61 emits a light beam 62 across the plates 60 and this light beam is received by a receiver 63 or detector which feeds a signal to the control circuit 47, as illustrated in FIG. 10, when the light beam 62 is uninterrupted. As shown in FIG. 8, the light beam is interrupted by the pouches and accordingly the receiver or detector 63 will not transmit a signal to the control circuit 47. In the event that only one or two pouches 16 are loaded on the conveyor, as shown in FIG. 9, these pouches will collapse and not obstruct the light beam 62 which will be detected by the receiver/detector 63 and a signal will be sent to the control circuit 47. This signal will cause the control circuit to arrest the piston cylinder 46 when the compartment with the improper number of pouches reaches the article discharge position 15. The roller element 40 will remain engaged under the surface 41 of the control plate and maintain the bottom trap wall 34 closed and accordingly, those articles will not be discharged. Simultaneously, the control circuit 47 will arrest the conveyors 20 and 21 and the bag opening and holding mechanism 13 until the indexing motor moves the compartment to the next 90° index position. This closed compartment will remain closed due to the shape of the control plate which maintains the roller element in engagement with its lower surface. However, upon reaching the article discharge position 36, the plate rear edge 49 is spaced further from the rear side frame or edge 30' of the turret support frame and this will cause the roller element 40 to become disengaged and therefore release the bottom trap wall of the compartment and the one or two pouches contained therein. A conveyor, not shown, will then convey these pouches back to a recycling position where they can be positioned again on the feed belt conveyor 21 and reloaded with a proper grouping.

It is within the ambit of the present invention to cover any obvious modifications of the preferred embodiment described herein, provided such modifications fall within the scope of the appended claims.

What is claimed is:

1. An automatic turret bagging machine for bagging a group of liquid pouches in a bag, said machine comprising a turret transport mechanism having four article receiving compartments; drive means to displace said compartments in synchronism from an article loading position, an article discharge position, an intermediate position and an article unloading position; each said compartment having a circumferential side wall, an open top end and a bottom trap door; said compartments being dimensioned to receive a group of two or more liquid pouches oriented in a predetermined manner by loading means at said loading position; a bag opening and holding mechanism for positioning and holding an open top end of a bag under said bottom trap door of said compartments at said article discharge position, controllable release means to release said bottom trap door of said compartments upon reaching said article discharge position to release said pouches contained in said compartment into said open top end of a bag positioned thereunder, transport means to displace said bag with said pouches therein away from said bag opening and holding mechanism, control means to synchronize the operation of said drive means, said bag opening and holding mechanism, said loading means and said controllable release means, detection means to detect the number of pouches being loaded into said compartment at said article loading position, said detection means providing a signal to said control means when the number of pouches is improper whereby said means to displace said control plate is rendered inoperative when said compartment reaches said article discharge position and said bag opening and holding mechanism is also rendered idle whereby said compartment is not discharged and said trap door follower means remains engaged with said control plate until it reaches said article unloading position wherein said improper number of pouches are discharged for recycling.

2. An automatic turret bagging machine as claimed in claim 1 wherein said controllable release means is a control plate displaceably supported in a plane disposed relative to said bottom trap door of said compartments, said bottom trap door having biased follower means secured thereto and having a bearing member disposed for displaceable arresting engagement against a lower surface of said control plate, means to displace said control plate from a trap door closed position to a trap door open position.

3. An automatic turret bagging machine as claimed in claim 2 wherein said follower means is constituted by a rod secured to said trap door and having a roller element secured thereto and displaceable on a pivot of said rod for displacing same for engagement on said lower support surface of said control plate, said roller element constituting said bearing member.

4. An automatic turret bagging machine as claimed in claim 3 wherein there is further provided automatic trap door closing means to cause said trap door of said compartment to close when said compartment is displaced from said unloading position to said article loading position.

5. An automatic turret bagging machine as claimed in claim 4 wherein said trap door closing means is constituted by an abutment edge formation of said control plate and disposed along a path of displacement of said compartments from said article discharge position to said article loading position to obstruct a side edge of said trap door and cause it to move automatically by the displacement of said compartment to a closed position and simultaneously position said bearing member against said lower support surface of said control plate, said compartment being ready to receive pouches at said article loading position.

6. An automatic turret bagging machine as claimed in claim 5 wherein said compartments are secured at right angles to one another on a square frame having opposed parallel side frame elements, said control plate is a substantially rectangular control plate formed with said abutment edge formation, said bearing member travelling substantially along a peripheral flat portion of said lower arresting surface thereof.

7. An automatic turret bagging machine as claimed in claim 6 wherein said means to displace said control plate is a piston having a piston rod end secured to said plate in non-obstructing relationship with said follower means.

8. An automatic turret bagging machine as claimed in claim 6 wherein said control plate has a front edge disposed adjacent said article discharge position, a rear edge disposed adjacent said article unloading position and opposed parallel side edges disposed respectively adjacent said article loading position and said intermediate position, said rear edge being spaced further away from said parallel frame member of said square frame a predetermined distance when said control plate is at said trap door engaging position.

9. An automatic turret bagging machine as claimed in claim 8 wherein said control plate when displaced to said trap door releasing position retracts said peripheral portion of said lower arresting surface thereof from said engagement with said bearing member thereby causing the weight of said pouches in said compartment at said loading position to open said trap door and fall by gravity into said open top end of a bag held thereunder at said loading position, said rear edge of said control plate being displaced closer to said parallel frame edge to position said abutment edge formation thereof along said path of displacement of said compartments to cause said trap wall of said compartment at said unloading position to pivot and close prior to reaching said loading position and to position said follower in engagement with said bottom surface of said control plate.

10. An automatic turret bagging machine as claimed in claim 6 wherein said drive means is an indexing motor controlled by said control means.

11. An automatic turret bagging machine as claimed in claim 1 wherein said pouches are liquid pouches, there being three of said pouches oriented in side-by-side longitudinal relationship, said compartments being rectangular compartments dimensioned to receive said three pouches in close fit therein.

12. An automatic turret bagging machine as claimed in claim 11 wherein said three pouches are oriented in said side-by-side longitudinal relationship by a feed belt conveyor having spaced-part pusher plates, said feed belt conveyor being fed said groups of pouches by two pouch collating and grouping machines disposed above said belt conveyor at a loading end of said belt conveyor.

13. An automatic turret bagging machine as claimed in claim 12 wherein said belt conveyor is provided with a steep inclined transfer conveyor section to cause said group of liquid pouches to position themselves by gravity against said pusher plates to ensure proper spaced-part grouping prior to discharge of said pouches into said compartment at said loading position.

14. An automatic turret bagging machine as claimed in claim 13 wherein there is further provided guide means interposed between a top discharge end of said feed conveyor and said open top end of said compartment at said loading position to maintain said three liquid pouches in side-by-side relationship.

15. An automatic turret bagging machine as claimed in claim 14 wherein said liquid pouches are milk pouches, said feed conveyor having a conveyor drive driven at a speed synchronized with said drive means of said compartments.

16. An automatic turret bagging machine as claimed in claim 12 wherein said detection means is beam transmitter and receiver disposed between guide walls at a discharge end of said feed belt conveyor to detect the presence of said three pouches disposed in side-by-side relationship.

17. An automatic turret bagging machine as claimed in claim 3 wherein said rod has a spring secured thereto to urge said roller element upwardly when said control plate is retracted to assist said trap door to open.

18. An automatic turret bagging machine as claimed in claim 1 wherein said transport means is a conveyor to transport said bag with said pouches therein to a bag open end film gathering station and to a closure application station.

* * * * *